US008376308B2

(12) United States Patent
Greve'

(10) Patent No.: US 8,376,308 B2
(45) Date of Patent: Feb. 19, 2013

(54) ADJUSTABLE PICTURE HANGER

(76) Inventor: Dean Norton Greve', West Bloomfield, MI (US)

( * ) Notice: Subject to any disclaimer, the term of this patent is extended or adjusted under 35 U.S.C. 154(b) by 268 days.

(21) Appl. No.: 12/579,811

(22) Filed: Oct. 15, 2009

(65) Prior Publication Data

US 2010/0096532 A1 Apr. 22, 2010

Related U.S. Application Data

(60) Provisional application No. 61/196,393, filed on Oct. 17, 2008.

(51) Int. Cl.
*A47G 1/24* (2006.01)

(52) U.S. Cl. ..... 248/496; 248/495; 248/323

(58) Field of Classification Search ..... 248/489, 248/495, 496, 497, 476, 477, 480, 323, 327, 248/339, 475.1
See application file for complete search history.

(56) References Cited

U.S. PATENT DOCUMENTS

| | | | | | |
|---|---|---|---|---|---|
| 2,697,572 | A | | 12/1954 | Pfankuch | |
| 2,975,994 | A | * | 3/1961 | Goss | 248/496 |
| 3,251,569 | A | | 5/1966 | Rynearson | |
| 3,914,892 | A | * | 10/1975 | Mohr | 40/759 |
| 4,161,977 | A | * | 7/1979 | Baslow | 160/381 |
| 4,272,047 | A | * | 6/1981 | Botka | 248/74.3 |
| 4,549,713 | A | | 10/1985 | Magadini | |
| 4,557,455 | A | * | 12/1985 | Benjamin | 248/496 |
| 4,566,665 | A | | 1/1986 | Rynearson | |
| 4,611,779 | A | | 9/1986 | Leonard, Jr. | |
| 4,641,807 | A | | 2/1987 | Phillips | |
| 5,484,032 | A | * | 1/1996 | Li | 188/24.21 |
| 5,947,438 | A | | 9/1999 | Lemire | |
| 6,003,825 | A | * | 12/1999 | Abernathy, Jr. | 248/478 |
| 6,032,915 | A | | 3/2000 | Brindisi | |
| 6,241,210 | B1 | * | 6/2001 | Brindisi | 248/476 |
| 6,299,123 | B1 | * | 10/2001 | Hayde | 248/476 |
| 6,550,739 | B1 | | 4/2003 | Brindisi | |
| 6,663,075 | B2 | | 12/2003 | Zuller | |
| 6,666,425 | B1 | * | 12/2003 | Ferguson | 248/477 |
| 6,957,797 | B1 | * | 10/2005 | Strobel | 248/477 |
| 7,234,671 | B2 | * | 6/2007 | Avinger | 248/215 |
| 7,578,492 | B2 | | 8/2009 | Darre' | |

OTHER PUBLICATIONS

Govart, Adjustable J-Hook for Picture Hanging; http://govart.com/hardware_spechook_A.html; Oct. 14, 2009; pp. 1-6.

Ace Hardware, Hillman 100lb Adjustable Picture Hangers (122388)—Mirror/Picture Hangers, http://www.acehardware.com/product/index.jsp?productID=3674413, Oct. 14, 2009, pp. 1-2.

Gracious Home, Product: Right Height Picture Hanger—http://www.gracioushome.com/webapp/wcs/stores/servlet/ProductDisplay_10001_10051, Sep. 11, 2009, p. 1.

* cited by examiner

*Primary Examiner* — Nkeisha Smith
(74) *Attorney, Agent, or Firm* — Brooks Kushman P.C.

(57) ABSTRACT

A picture frame hanger is provided with an elongate strip having a base for mounting upon an upright support surface. The base includes at least one cavity extending inward from opposing surfaces to intersect and collectively form an aperture for receiving a fastener at an angle to one of the at least one cavities. The strip includes a series of teeth and a key along a length of the strip. A carriage is mounted for translation along the elongate strip, and includes a keyway that cooperates with the key for orienting the carriage relative to the strip. A flange is provided for receiving a picture frame support member. A latch is pivotally connected to the carriage for engaging the teeth. A user may disengage the latch from the strip for adjusting an upright position of the carriage. A method for forming the aperture of the elongate strip is provided.

21 Claims, 5 Drawing Sheets

ADJUSTABLE PICTURE HANGER

CROSS-REFERENCE TO RELATED APPLICATIONS

This application claims the benefit of U.S. provisional application Ser. No. 61/196,393 filed Oct. 17, 2008, the disclosure of which is incorporated by reference herein.

BACKGROUND

1. Technical Field

Embodiments of the invention relate to a hanger for supporting a picture frame.

2. Background Art

Traditional hangers for supporting picture frames include a hook that is fastened to the wall. Such hooks typically curve upwards and are configured for receiving a support bracket of a picture frame. There are also a number of adjustable picture frame hangers disclosed in the prior art that allow a user to adjust a vertical position of the picture after the hanger is fastened to the wall.

SUMMARY

In at least one embodiment a picture frame hanger is provided with an elongate strip for mounting upon an upright support surface. The strip includes a series of transverse teeth that are spaced along a length of the strip and a key extending substantially along the length of the strip. A carriage is mounted for translation along the elongate strip for selective adjustment of an upright position relative to the elongate strip. The carriage includes a keyway that cooperates with the key for orienting the carriage relative to the strip. A flange extends upward from the carriage and is sized to receive a picture frame support member. A latch is pivotally connected to the carriage for engaging the series of teeth. A user may disengage the latch from the strip for adjusting an upright position of the carriage.

In another embodiment a picture frame hanger is provided with an elongate strip for resting upon an upright support surface. The strip includes at least one base for mounting to the upright support surface. The base includes at least one cavity extending inward from both a rearward surface and a forward surface to intersect and collectively form an aperture through the base for receiving a fastener at an angle to one of the at least one cavities. The strip also includes a series of transverse teeth and a first guide member along a length of the strip. A bracket cooperates with the elongate strip for selective adjustment of an upright position relative to the elongate strip. The bracket includes a second guide member that cooperates with the first guide member for orienting the bracket relative to the strip. A flange extends upward from the bracket and is sized to receive a picture frame support member. A latch is pivotally connected to the bracket for engaging the series of teeth. A user may disengage the latch from the strip for adjusting an upright position of the bracket.

In yet another embodiment, a method for forming an angled aperture through an elongate strip of an adjustable picture hanger is provided. A first mold portion is provided having a first forming surface with a first series of projections. Each of the first series of projections extends further from the first surface than an upper adjacent projection. A second mold portion is provided having a second forming surface with a second series of projections. Each of the second series of projections extends further from the second surface than a lower adjacent projection. The first mold portion engages with the second mold portion to form an elongate strip cavity, where the first series projections partially overlap adjacent second series projections. The elongate strip is molded, whereby the overlapping of the projections collectively forms an angled aperture in the molded elongate strip.

DETAILED DESCRIPTION OF EMBODIMENTS

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
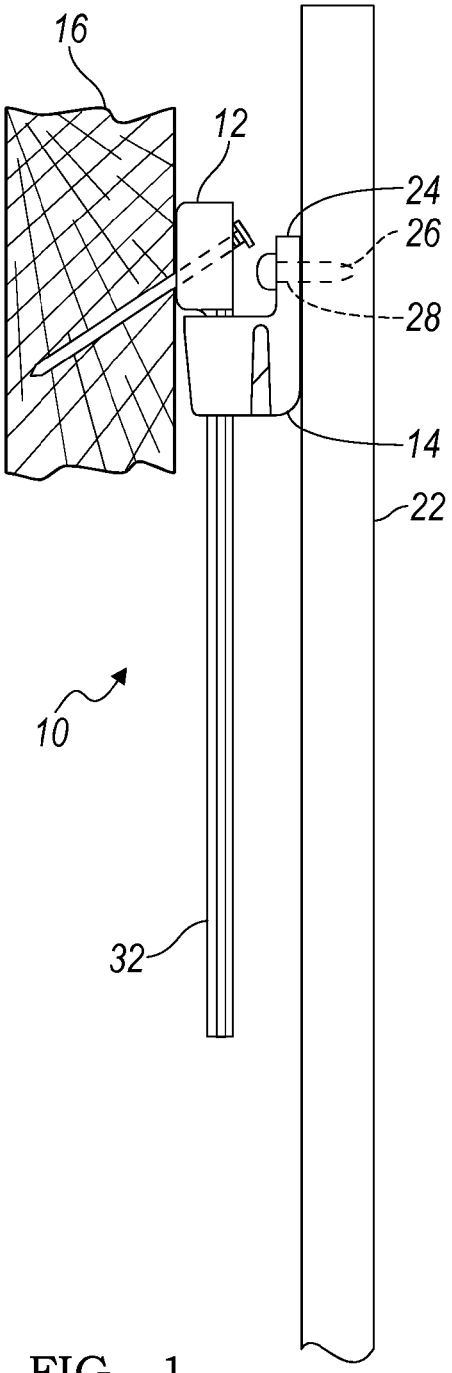
FIG. 1 is a side elevation view of an adjustable picture hanger according to an embodiment of the present invention, illustrated adjusted to an upper position, mounted to a wall and supporting a picture frame.
Figure 2:
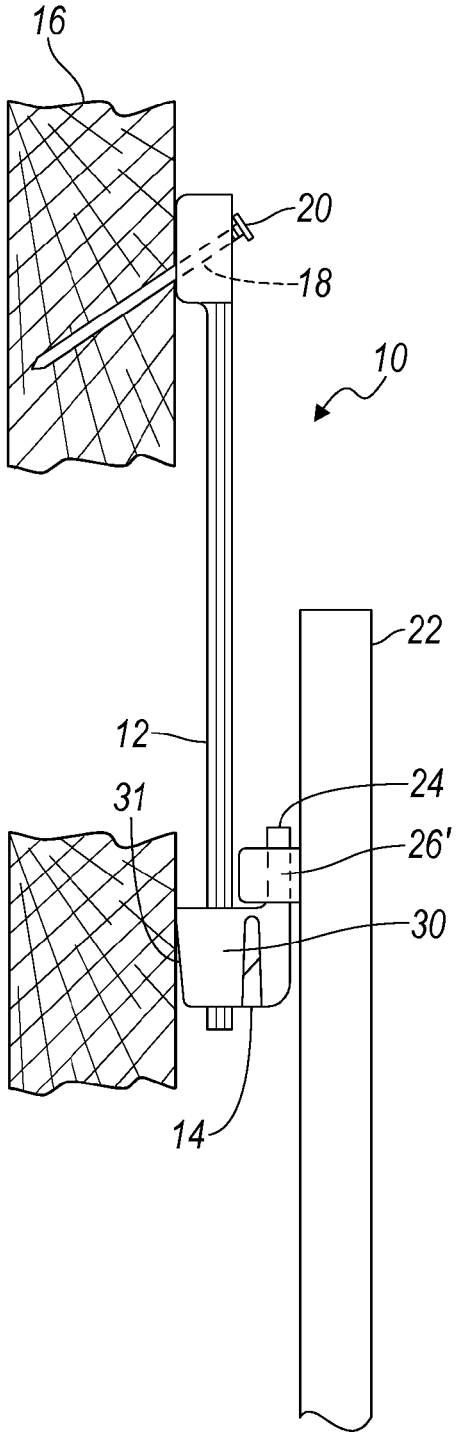
FIG. 2 is another side elevation view of the adjustable picture hanger of FIG. 1, illustrated adjusted to a lower position.

With reference now to FIGS. 1 and 2, an adjustable picture hanger is illustrated in accordance with an embodiment of the present invention and is referenced by numeral 10. The adjustable hanger 10 is configured to support pictures, photographs, artwork wall decorations and all items similar which require a mounting unit attached to the wall to support the weight of the item which is to be hung. The adjustable hanger 10 allows a user to selectively adjust a vertical position of the picture. For example, a user may mount a picture to a wall using the hanger 10. Later the user, may decide the picture should be adjusted vertically up or down. The user may adjust the hanger 10 while the picture is still mounted. Or the user may remove the picture from the hanger 10, adjust the hanger 10 up or down accordingly, and replace the picture in the desired position.

The adjustable picture hanger 10 includes an elongate strip 12 cooperating with a bracket or carriage 14. The carriage 14 is mounted for translation along the elongate strip 12 for selective adjustment of an upright position relative to the strip 12. The carriage 14 may adjust from an upper position (FIG. 1), to a lower position relative to the strip (FIG. 2).

The elongate strip 12 is configured for mounting upon an upright support surface 16. The support surface 16 may be a typical wall in a home or office made of wood, drywall, plaster, lathing or sheet metal. The strip 12 includes an aperture 18 that is sized for receiving a fastener 20. The size of the aperture 18 and type of fastener 20 depend on the material of the support surface 16 and the weight of the object to be supported by the hanger 10. For example, a strip 12 having a fifteen mm diameter aperture 18 may be used for a application where the hanger 10 is mounted to a wood support surface 16 using a nail for a fastener 20 and supporting a twenty pound load. Other embodiments envision a larger diameter aperture 18 for receiving a screw or drywall anchor (not shown).

The carriage 14 is configured for coupling a picture frame 22 to the hanger 10. A flange 24 extends upward from the carriage 14, and is oriented generally parallel to the strip 12. The picture frame 22 includes a support member 26 for attaching the picture frame 22 to the hanger 10. The flange 24 is sized for receiving various types of picture frame support members 26. For example, the flange 24 may include a slot 28 for receiving a fastener support member 26 as depicted in FIG. 1. The flange 24 is offset from the strip 12 to form a pocket that is sized for receiving a bracket support member 26' as depicted in FIG. 2. Additionally the flange 24 may receive a wire or string support member (not shown).

The adjustable hanger 10 allows a user to adjust the height of the picture 22 being hung vertically by sliding the carriage 14 up or down the strip 12. While other prior art "picture hangers" require precise measurements to position a picture at a desired position, the adjustable hanger 10 allows the user to reposition the picture 22, up or down, without having to re-nail the hanger 10.

The carriage 14 includes a main body 30 having a brace 31 for resting upon the upright support surface 16. The brace 31 is formed by a generally planar rear surface of the main body 30. When the hanger 10 is supporting a picture frame 22, the weight of the frame 22 creates a moment about the fastener 20 such that the strip 12 flexes and the brace 31 contacts the upright surface 16. By contacting the upright support surface 16, the brace 31 helps distribute the load supported by the hanger 10 (FIG. 2).

According to at least one embodiment, multiple hangers 10 are used to support a single picture frame 22. For example, a pair of hangers 10 may each be coupled to a lateral edge of a picture frame 22. Additionally, multiple hangers 10 may be used to receive a single wire support member.

Figure 3:
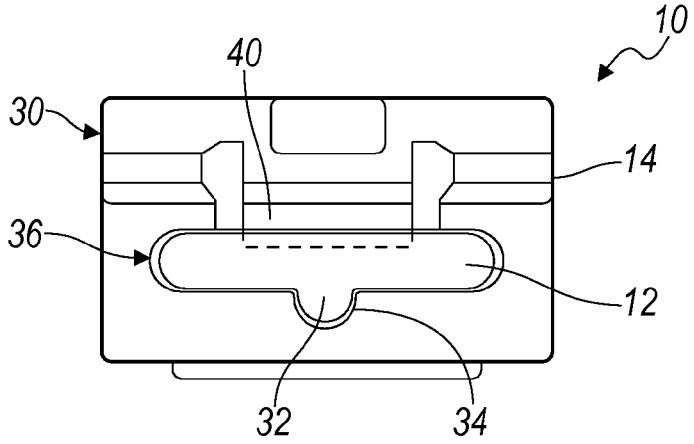
FIG. 3 is an enlarged bottom end view of the adjustable picture hanger of FIG. 1.

Referring to FIGS. 1-3, the adjustable hanger 10 includes a key 32 cooperating with a keyway 34 for orienting the strip 12 and the carriage 14 relative to one another. The key 32 extends outward from a rear surface of the strip 12. The key 32 is centrally aligned relative to a width of the strip 12 and extends longitudinally along a substantial length of the strip 12. The key 32 enhances the structural integrity of the strip 12. The carriage 14 includes a slot 36 formed within the main body 30 for receiving the elongated strip 12. The keyway 34 is formed within the slot 36 for receiving the key 32 and maintaining a lateral orientation of the carriage 14 relative to the strip 12. The key 32/keyway 34 interface also helps prevent a user from assembling the carriage 14 backwards or 180 degrees offset from the strip 12. One embodiment of the adjustable hanger 10 includes multiple keys (not shown) extending along the length of the elongate strip, and a carriage having multiple keyways corresponding to the keys.

Figure 4:
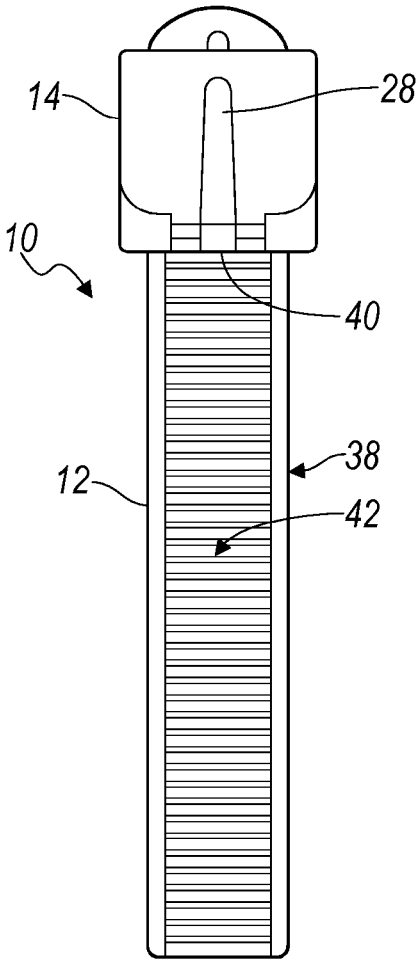
FIG. 4 is a front elevation view of the adjustable picture hanger of FIG. 1, illustrated in the upper position.
Figure 5:
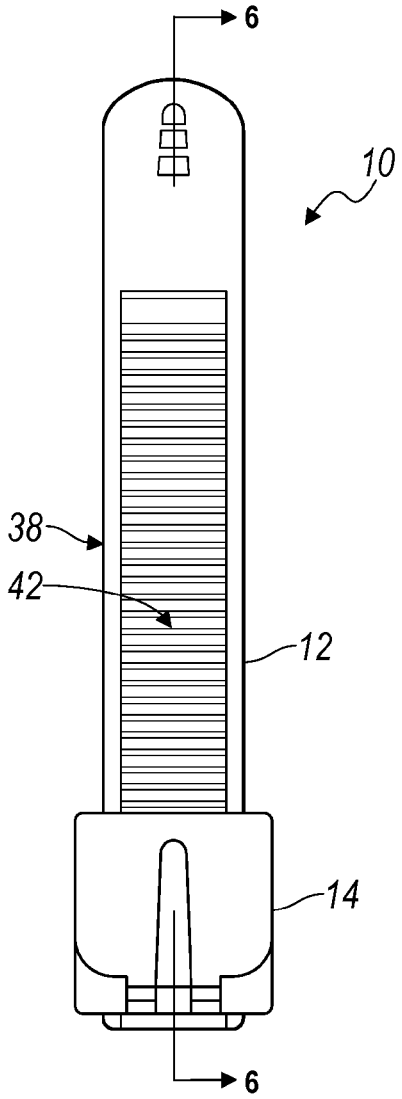
FIG. 5 is another front elevation view of the adjustable picture hanger of FIG. 1, illustrated in the lower position.

Referring to FIGS. 3-5, the adjustable hanger 10 includes a rack 38 and a pawl 40 that are coupled to one another for selective adjustment of an upright position of the carriage 14. The rack 38 is formed by a series of transverse teeth 42 that are incrementally spaced along the length of the strip 12. The pawl 40 is pivotally connected to the carriage 14 for engaging one of the series of teeth 42, thereby latching the carriage 14 to the strip 12. As illustrated in FIG. 3, the pawl 40 extends into the slot 36 to interfere with the strip 12, and engage a tooth 42, when the carriage is not loaded. Therefore, the pawl 40 as molded is biased towards the rack 38. To adjust a vertical position of the carriage 14, a user first applies a force to the carriage 14 to pivot the pawl 40 out of engagement with the rack 38, then translates the carriage 14 to a desired vertical position. Once the carriage 14 is in a desired vertical position, the user stops applying the force to the carriage 14, and the pawl 40 returns to its naturally biased position engaging a tooth 42 and locking the carriage to the rack 38.

The elongate strip 12 including the rack 38, is configured for supporting the weight of the picture frame 22 on each individual tooth 42. The rack 38 may be formed by a high strength polymer, such as Nylon. For example the rack 38 may be formed from injection molding Wellamid® GF33-66 resin, which is a thirty three percent glass fiber reinforced Nylon 66 (Polyamide 66) plastic material provided by Wellman Engineering Resins of Johnsonville, S.C.

Figure 6:
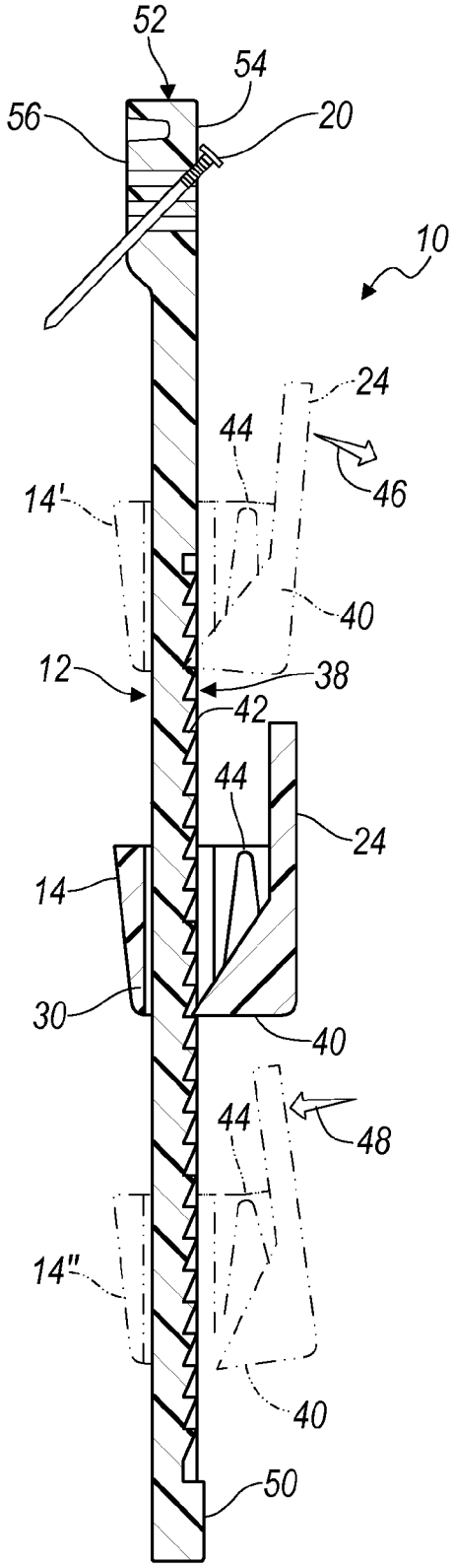
FIG. 6 is an enlarged section view of the adjustable picture hanger of FIG. 4, taken along section line 6-6, illustrated adjusted to an intermediate position.

Referring to FIG. 6, the series of teeth 42 extend forward from the strip 12. The teeth 42 are longitudinally spaced along the length of the strip 12. For example the teeth 42 may be spaced at 1/32 inch (approximately 0.8 mm) increments. The teeth 42 are formed in a sawtooth configuration where each tooth 42 transversely extends away from the strip 12 then slopes downward towards the strip 12 to a root of the next tooth 42.

A hinge 44 is provided for pivotally connecting the pawl 40 to the main body 30 of the carriage 14. The pawl 40 extends downward from the flange 24 relative to the hinge 44. As molded, the pawl 40 is biased to engage the rack 38 when the carriage 14 is unloaded. The carriage 14 may be molded from a unitary polymer such that the hinge 44 is a "living hinge" that is formed by a thin piece of polymer that pivotally connects the pawl 40 to the main body 30. The hinge 44 allows the pawl 40 to pivot toward the rack 38 for further engagement, and away from the rack 38 for disengagement. Such a carriage 14 may be formed of a polypropylene for providing high strength and flexibility in the living hinge 44. For example the carriage 14 may be formed from injection molding Thermylene® P6-30FG-600 resin, which is a polypropylene homopolymer provided by Asahi Kasei Plastics North America Inc. of Fowlerville, Mich.

The pawl 40/rack 38 interface is configured for allowing the carriage 14 to translate or ratchet in an upward direction but lock to prevent translation downward. FIG. 6 illustrates the pawl 40 of the carriage 14 in various stages of engagement with the rack 38. The carriage 14 that is positioned at an intermediate portion of the strip 12, is illustrated in an unloaded position where the pawl 40 partially engages the rack 38. The locked carriage 14' that is positioned at an upper portion of the strip 12, and shown in a phantom view, is illustrated in a loaded position where the pawl 40 fully engages the rack 38. The released carriage 14" that is positioned at a lower portion of strip 12, and also shown in a phantom view, is illustrated in a released position where the pawl 40 is disengaged from the rack 38.

The carriage 14 is configured such that the pawl 40 partially engages the rack 38 when the hanger 10 is unloaded and not supporting the weight of the picture frame 22. The hinge 44 is configured to bias the pawl 40 toward the rack 38 for engaging an individual tooth 42. By applying an upward axial force to the carriage 14, the pawl 40 pivots about the hinge 44 and slides up and over each tooth 42 into the root of the next tooth 42. However, the sawtooth profile of the teeth 42 prevents downward translation of the carriage 14. When a downward axial force is applied to the carriage 14, the pawl 40 catches on the transverse surface of the tooth 42 and prevents downward translation.

The locked carriage 14' illustrated in the upper phantom view of FIG. 6, includes the pawl 40 in full engagement with the rack 38. When a picture frame 22 is attached to the adjustable hanger 10, the pawl 40 further engages the rack 38 to prevent downward translation. When the hanger 10 is supporting a picture frame 22, the weight of the frame 22 creates a moment about the hinge 44, which is represented by force arrow 46 acting on flange 24. The moment forces the pawl 40 to pivot about the hinge 44 to further engage a tooth 42 and lock the carriage 14' to the rack 38.

The released carriage 14" illustrated in the lower phantom view of FIG. 6, includes the pawl 40 disengaged from the rack 38. A transverse force (as represented by force arrow 48) applied to the flange 24 and toward the strip 12, creates a moment about the hinge 44 that disengages the pawl 40 from a tooth 42 of the rack 38. By maintaining this force 48 a user may slide or translate the carriage 14" upward or downward. This approach may be used to remove the carriage 14" from the strip 12. Additionally, since the elongate strip 12 only needs to be mounted at an upper position, the carriage 14" may be removed from a lower portion of the strip 12 without removing the fastener 20.

The strip 12 may include an endstop 50 to prevent inadvertent removal of the carriage 14. As mentioned above a transverse force 48 is applied the flange 24 to translate the carriage 14" downward. An endstop 50 having a thickness that is greater than the thickness a tooth 42 would require a larger transverse force to be applied to the flange 24 in order to pivot the pawl 40 far enough to clear the stop 50.

Figure 7:
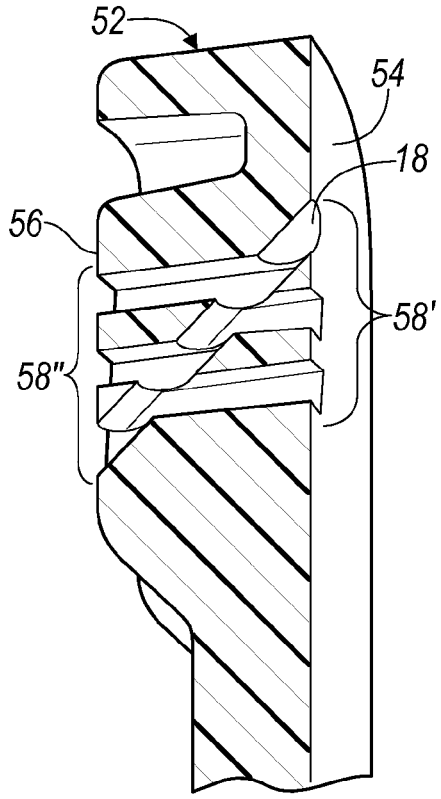
FIG. 7 is an enlarged perspective section view of a base of the adjustable picture hanger of FIG. 6.
Figure 14:
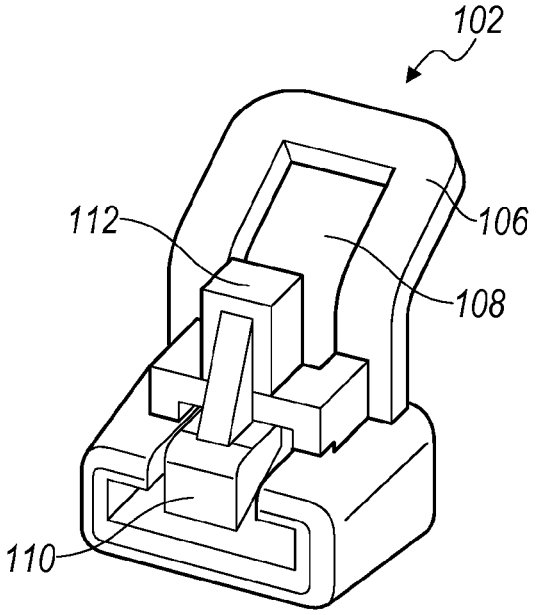
FIG. 14 is an enlarged perspective view of a carriage of the adjustable picture hanger of FIG. 11.

FIG. 7, depicts an enlarged perspective view of the base 52 of FIG. 6, and illustrates the aperture 18 for receiving a mounting fastener (not shown). The base 52 includes a forward surface 54 and a rearward surface 56. The rearward surface 56 rests upon the upright surface (not shown). The aperture 18 is formed at a declining angle from the forward surface 54 to the rearward surface 56 of the base 52.

The elongate strip 12 may be manufactured by injection molding a polymer, such as glass-filled nylon. Creating an aperture at an angle, such as that of aperture 18 may be difficult with a traditional two piece mold. A method is provided for forming the angled aperture 18 through the elongate strip 12 during the injection molding process (not shown). The mold includes a first mold portion (not shown) having a forming surface for a first series of projections. Each of the first series of projections extend further from the surface than an upper adjacent projection. The mold includes a second mold portion (not shown) having a forming surface for a second series of projections. Each of the second series of projections extends further from the surface than a lower adjacent projection (not shown). The first mold portion engages the second mold portion, and the first series of projections partially overlap with the adjacent second series of projections. A polymer is injected into the mold such that the overlapping of the projections collectively forms the angled aperture 18 in the molded strip 12.

Regarding FIG. 7, a series of forward cavities 58', formed by the first series of projections, project inward from the forward surface 54. Each forward cavity 58' extends to a greater depth than an upper adjacent forward cavity 58'. A series of rearward cavities 58", formed by the second series of projections, project inward from the rearward surface 56. Each rearward cavity 58" extends to a greater depth relative to a lower adjacent rearward cavity 58". The overlap of the adjacent projections allows the forward cavities 58' to intersect with the rearward cavities 58" to collectively form the aperture 18 at a declining angle from the forward surface 54 to the rearward surface 56.

In another embodiment of a method for forming the aperture 18, a slide or projectable pin (not shown) may be added to the molds to form the aperture 18 during the mold process. In yet another embodiment, the aperture 18 may be formed by a secondary operation, where after each strip 12 is molded, the strip 12 is held in a fixture and the aperture 18 is formed (e.g, by drilling).

Figure 8:
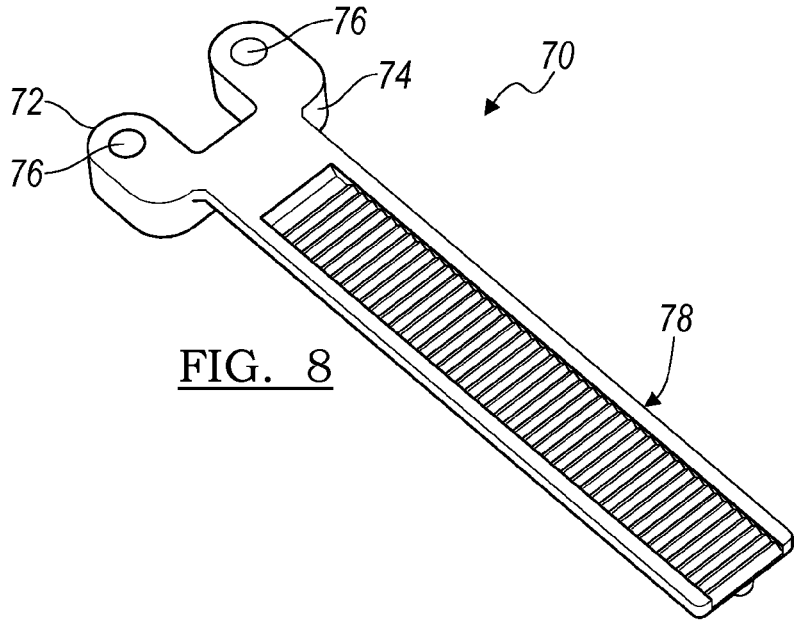
FIG. 8 is a perspective view of an elongate strip according to another embodiment of the present invention.

Referring to FIG. 8, one embodiment of the adjustable hanger includes an elongate strip 70 having multiple bases for supporting heavier loads. The elongate strip 70 includes a first base 72 and a second base 74 positioned adjacent to one another. An aperture 76 is formed within each base 72 and 74 for receiving a fastener (not shown). The first and second bases 72, 74, converge to form a lower strip portion 78 wherein a series of teeth and a key are formed. The strip 70 may be configured to cooperate with the carriage 14 described above.

Figure 9:
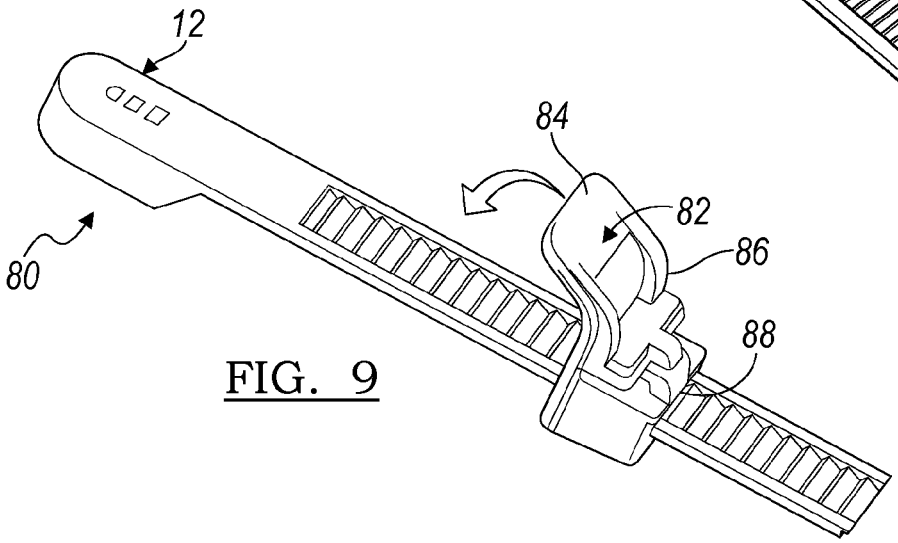
FIG. 9 is a perspective view of an adjustable picture hanger according to yet another embodiment of the present invention.
Figure 10:
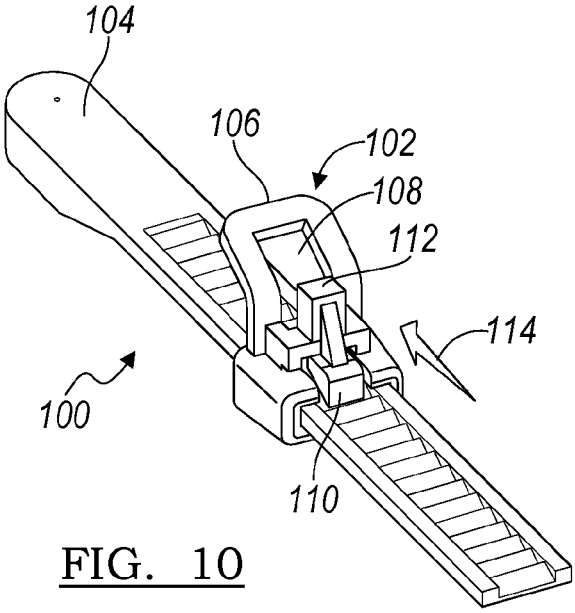
FIG. 10 is a perspective view of an adjustable picture hanger according to another embodiment of the present invention.

FIG. 9 depicts another embodiment of the adjustable hanger 80. The hanger 80 includes a carriage 82 cooperating with the elongate strip 12. The carriage 82 includes a flange 84 that curves upward and away from the strip 12. The carriage 82 may include gussets 86 for providing additional strength to the flange 84. A pawl 88 is pivotally coupled to the carriage 82. The pawl 88 is also coupled to the flange 84 such that a transverse force applied to the flange 84 engages or disengages the pawl 88 (and carriage 82) from the strip 12.

With reference to FIGS. 10-14, an adjustable picture hanger is illustrated in accordance with another embodiment of the present invention and is referenced by numeral 100. The hanger 100 includes a carriage 102 cooperating with an elongate strip 104. The carriage 102 includes a flange 106 that curves upward and away from the strip 104. The carriage 102 includes a slot 108 formed along the flange 106. A pawl 110 is pivotally coupled to the carriage 102. A lever 112 is coupled to the pawl 110 and extends transversely from the strip 104. The slot 108 is sized for receiving the lever 112. The lever 112 is coupled to the pawl 110 such that an upward force (represented by arrow 114) applied to the lever 112 engages or disengages the pawl 110 (and carriage 102) from the strip 104.

Figure 11:
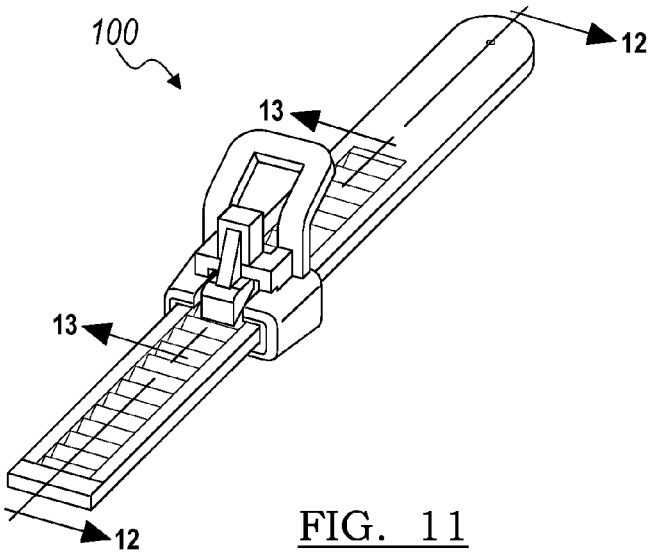
FIG. 11 is a perspective view of an adjustable picture hanger according to another embodiment of the present invention.
Figure 12:
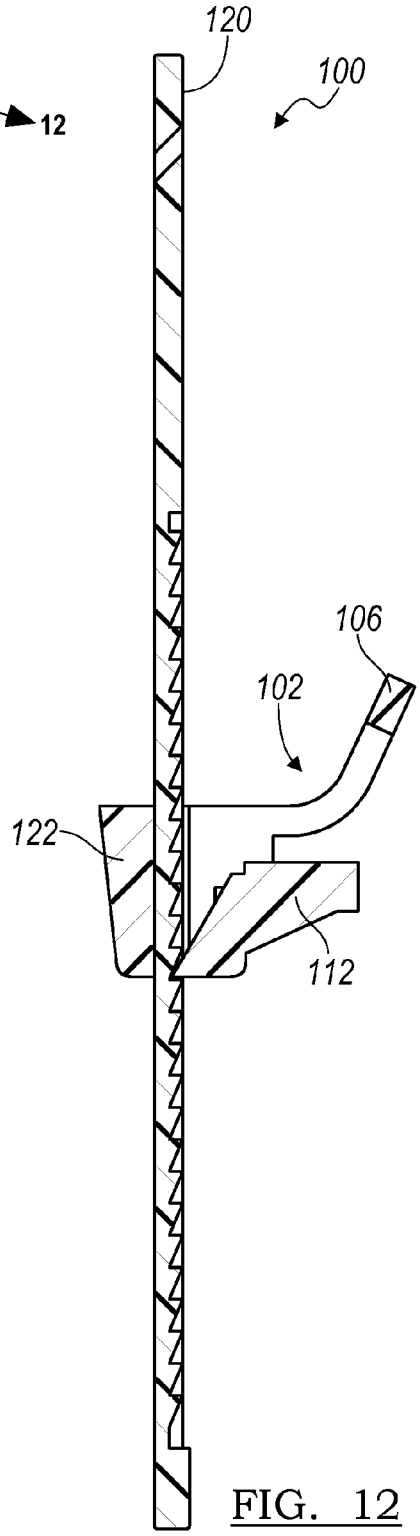
FIG. 12 is an enlarged section view of the adjustable picture hanger of FIG. 11, taken along section line 12-12.
Figure 13:
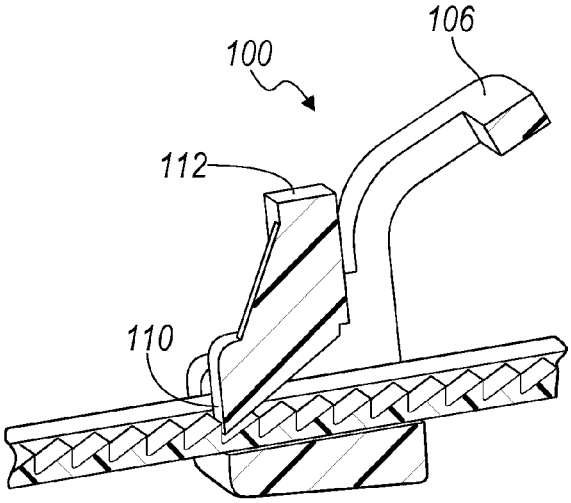
FIG. 13 is an enlarged section view of the adjustable picture hanger of FIG. 11, taken along section line 13-13.

FIGS. 11-13 illustrate the adjustable hanger 100 with an elongated strip 120 having a generally uniform thickness. Such a strip 120, would flex away from an upright support surface (not shown) to account for a thickness of a carriage brace 122.

The adjustable picture hanger is a picture perfect hanger that will allow the user to hang items such as, but not limited to, pictures, photographs, artwork, wall decorations and all items similar which require a mounting unit attached to the wall to support the weight of the item which is to be hung.

Unlike all others before it, the picture perfect hanger allows the user to adjust the height of the item being hung vertically by simply sliding the support hook up or down the track. While other "picture hangers" require precise measurements to position the hung item at the desired position, the picture perfect hanger allows the user to reposition the hung item, up or down, without having to re-nail the hanging hook. The item can be adjusted up or down to within 1/32 of an inch. No more pounding several nail holes into the wall to finally end up with the hung item at the desired height.

To use the picture perfect hanger, simply determine where you want to hang an item on the wall or mounting surface. Pound the provided nail through the hole in the top of the hanger into the surface so the nail head is flush with the plastic vertical rail of the picture perfect hanger. Using whatever support mechanism, most commonly wire, or frame brackets, which have been attached to the item you wish to hang, place the item to be hung on the picture perfect hanger. If the hung item is too high or too low simply lift it off the picture perfect hanger, and adjust the item up or down to desired height. The item can always be re-adjusted at any time by simply sliding the hook of the perfect picture hanger up or down.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A picture frame hanger comprising:

an elongate strip for mounting upon an upright support surface, the strip having a series of transverse teeth spaced along a length of the strip and a key extending substantially along the length of the strip for enhancing structural integrity of the strip;

a carriage mounted for translation along the elongate strip for selective adjustment of an upright position relative to the elongate strip, the carriage having a keyway cooperating with the key for orienting the carriage relative to the strip;

a flange extending upward from the carriage and spaced apart from the elongate strip to form a pocket therebetween to receive a portion of a picture frame support member extending from a picture frame, wherein the flange is adapted to retain the portion of the picture frame support member within the pocket for connecting the picture frame to the carriage; and a latch pivotally connected to the carriage for engaging the series of teeth, wherein a user may disengage the latch from the strip for adjusting an upright position of the carriage.

2. The picture frame hanger of claim 1 wherein the series of teeth extend away from the upright support surface and are longitudinally spaced along the length of the strip.

3. The picture frame hanger of claim 2 wherein the carriage further comprises at least one living hinge pivotally connecting both the flange and the latch to the carriage.

4. The picture frame hanger of claim 3 wherein the latch further comprises a pawl extending downward relative to the at least one hinge, the pawl being biased toward the teeth for engaging an individual tooth, and wherein the flange and the pawl extend in opposing directions from the hinge such that the user may disengage the pawl from the individual tooth by applying a transverse force to the flange.

5. The picture frame hanger of claim 1 wherein the elongate strip further comprises an upper base for mounting to the upright surface, the base having an aperture projecting therethrough and sized for receiving a fastener.

6. The picture frame hanger of claim 5 wherein the aperture is formed at a declining angle from a forward surface of the upper base to a rearward surface.

7. The picture frame hanger of claim 6 wherein the aperture is formed by a series of forward cavities projecting from the forward surface intersecting with a series of rearward cavities projecting from the rearward surface.

8. The picture frame hanger of claim 7 wherein each forward cavity extends to a greater depth than an upper adjacent forward cavity, and each rearward cavity extends to a greater depth relative to a lower adjacent rearward cavity.

9. The picture frame hanger of claim 1 wherein the flange further comprises a slot for receiving a fastener to attach the picture frame thereto.

10. The picture frame hanger of claim 9 wherein the flange is oriented generally parallel to the strip.

11. The picture frame hanger of claim 9 wherein the flange is oriented to curve upward and outward from the carriage.

12. The picture frame hanger of claim 1, wherein the elongate strip further comprises an endstop extending from a distal end of the strip, the endstop having a thickness greater than a corresponding thickness of the series of teeth for limiting inadvertent removal of the carriage from the elongate strip.

13. A picture frame hanger comprising:

an elongate strip for resting upon an upright support surface the strip further comprising:

at least one base for mounting to the upright support surface, the base having a rearward surface for resting upon the upright support surface and a forward surface offset from the rearward surface, the base having at least one cavity extending inward from both the rearward surface and the forward surface to intersect and collectively form an aperture through the base for receiving a fastener at an angle to one of the at least one cavities, a series of transverse teeth spaced along a length of the strip, a first guide member extending substantially along the length of the strip; and a bracket cooperating with the elongate strip for selective adjustment of an upright position relative to the elongate strip, the bracket further comprising:

a second guide member cooperating with the first guide member for orienting the bracket relative to the strip, a flange extending upward from the bracket and spaced apart from the elongate strip and sized to receive a picture frame support member, a latch pivotally connected to the bracket for engaging the series of teeth, wherein a user may disengage the latch from the strip for adjusting an upright position of the bracket.

14. The picture frame hanger of claim 13 wherein the first guide member further comprises at least one key extending along a rear side of the strip.

15. The picture frame hanger of claim 14 wherein the at least one key is centrally oriented.

16. The picture frame hanger of claim 13 wherein the series of teeth further comprise a sawtooth configuration for allowing the bracket to translate upwards by applying an axial force to the bracket.

17. The picture frame hanger of claim 13 wherein the bracket is selectively removable from the elongated strip while the base remains mounted to the upright surface, by disengaging the latch from the teeth and translating the bracket downward.

18. The picture frame hanger of claim 17 wherein the bracket further comprises a brace for resting upon the support surface to distribute a load of a picture frame.

19. The picture frame hanger of claim 18 wherein the flange is oriented to curve upward and outward from the bracket.

20. The picture frame hanger of claim 13 wherein the elongate strip further comprises a first base and a second base converging to form a lower strip portion wherein the series of teeth and first guide member are formed.

21. A picture frame hanger comprising:

an elongate strip for mounting upon an upright support surface, the strip having a series of transverse teeth spaced along a length of the strip;

an endstop extending from a distal end of the strip and beyond the series of transverse teeth;

a carriage mounted for translation along the elongate strip for selective adjustment of an upright position relative to the elongate strip, wherein the endstop has a thickness greater than a corresponding thickness of the series of transverse teeth for limiting inadvertent removal of the carriage from the elongate strip;

a flange pivotally connected to the carriage at a hinge and spaced apart from the elongate strip to form a pocket to receive a portion of a picture frame, wherein the flange is adapted to retain the portion of the picture frame within the pocket for connecting the picture frame to the carriage; and a pawl pivotally connected to the hinge and extending downward from the hinge, the pawl being biased toward the series of transverse teeth for engaging an individual tooth, and wherein the flange and the pawl extend in different directions from the hinge such that the user may disengage the pawl from the individual tooth for adjusting an upright position of the carriage by applying a transverse force to the flange.

* * * * *